US006003918A

United States Patent [19]

Hulyk

[11] Patent Number: 6,003,918

[45] Date of Patent: Dec. 21, 1999

[54] FLEXIBLE CARRIER FOR CLOTHES HANGERS

[76] Inventor: Myron Hulyk, 20037 Edmunton, Saint Clair Shores, Mich. 48080

[21] Appl. No.: 09/200,695

[22] Filed: Nov. 27, 1998

[51] Int. Cl.[6] ..... A45F 5/10

[52] U.S. Cl. ..... 294/149; 294/142; 224/927

[58] Field of Search ..... 294/31.2, 137, 294/149, 150, 156, 170, 171, 142, 74; 224/313, 927; 383/4, 902; 24/17 B, 17 AP, 16 PB; 223/85, 88, DIG. 4

[56] References Cited

U.S. PATENT DOCUMENTS

| | | | |
|---|---|---|---|
| 3,554,417 | 1/1971 | Yorty | 294/149 |
| 3,584,772 | 6/1971 | Robertson . | |
| 3,670,937 | 6/1972 | Bradshaw | 294/170 |
| 3,675,834 | 7/1972 | Peters | 294/149 |
| 4,039,218 | 8/1977 | Bryant | 294/74 |
| 4,098,484 | 7/1978 | Gray . | |
| 4,153,189 | 5/1979 | Hughes | 294/156 |
| 4,856,688 | 8/1989 | Ackmann . | |
| 5,405,067 | 4/1995 | Huges . | |
| 5,829,725 | 11/1998 | Russo . | |

*Primary Examiner*—Dean J. Kramer
*Attorney, Agent, or Firm*—Peter D. Keefe

[57] ABSTRACT

A flexible clothes hanger carrier which serves to allow someone to carry a number of clothes hangers comfortably even if these hangers are heavily weighted with clothes, and further allows a plurality of hangers to be simultaneously hung on a vehicular hook member. The flexible clothes hanger carrier is composed of an axially crumpled flaccidly flexible tube of plastic sheeting having mutually opposing first and second open ends. In a preferred method of production, the flaccidly flexible tube is provided from a plastic bag in which the closed end thereof has been cut away to thereby form a second open end opposite the bag mouth (which inherently supplies the first open end). The flaccidly flexible tube is then crumpled into a flexible loop which provides the flexible clothes hanger carrier. The hook portion of clothes hangers are interfaced with the flexible loop constituting the flexible clothes hanger carrier by being hooked thereonto.

6 Claims, 2 Drawing Sheets

FLEXIBLE CARRIER FOR CLOTHES HANGERS

BACKGROUND OF THE INVENTION

1. Field of the Invention

The present invention relates to clothes hangers, and more particularly to a carrier which interfaces with the hook portion of clothes hangers. Still more particularly, the present invention relates to a hanger carrier composed of a crumpled plastic sheeting.

2. Description of the Prior Art

Clothes hangers are particularly well suited to carrying clothes, but the hook portion thereof can be bothersome to carry at times. For example, metal clothes hangers utilize wire in their construction so that when someone holds the hook portion thereof in his or her hand, the hook portion tends to discomfortingly bite into the fingers or palm. This situation is exacerbated when multiple hangers are held and/or each hanger has relatively weighty clothes hung thereupon.

Another problem that arises with clothes hangers is the difficulty to simultaneously attach many clothes hangers to the vehicular hook member of an automotive passenger compartment. Devices are known which serve to aid the placement of multiple hangers onto a vehicular hook member, but these are generally costly and not disposable.

Accordingly, what is needed is a simple, inexpensive and disposable clothes hanger carrier which serves to allow someone to carry a number of clothes hangers comfortably even if they support heavy clothes, and further allows a plurality of hangers to be simultaneously hung on a vehicular hook member.

SUMMARY OF THE INVENTION

The present invention is a simple, inexpensive and disposable flexible clothes hanger carrier which serves to allow someone to carry a number of clothes hangers comfortably even if these hangers are heavily weighted with clothes, and further allows a plurality of hangers to be simultaneously hung on a vehicular hook member.

The flexible clothes hanger carrier according to the present invention is composed of an axially crumpled flaccidly flexible tube of plastic sheeting having mutually opposing first and second open ends. In a preferred method of production, the flaccidly flexible tube is provided from a plastic bag in which the closed end thereof has been cut away to thereby form a second open end opposite the bag mouth (which inherently supplies the first open end). The flaccidly flexible tube is then kneaded by hand or handled by machine so as to be crumpled into a flexible loop which provides the flexible clothes hanger carrier. The hook portion of clothes hangers are interfaced with the flexible loop constituting the flexible clothes hanger carrier by being hooked thereonto.

Accordingly, it is an object of the present invention to provide a simply constructed, easily used and disposable carrier for clothes hangers.

It is an additional object of the present invention to convert a plastic bag into a clothes hanger carrier.

These, and additional objects, advantages, features and benefits of the present invention will become apparent from the following specification.

DETAILED DESCRIPTION OF THE PREFERRED EMBODIMENT

Figure 1:
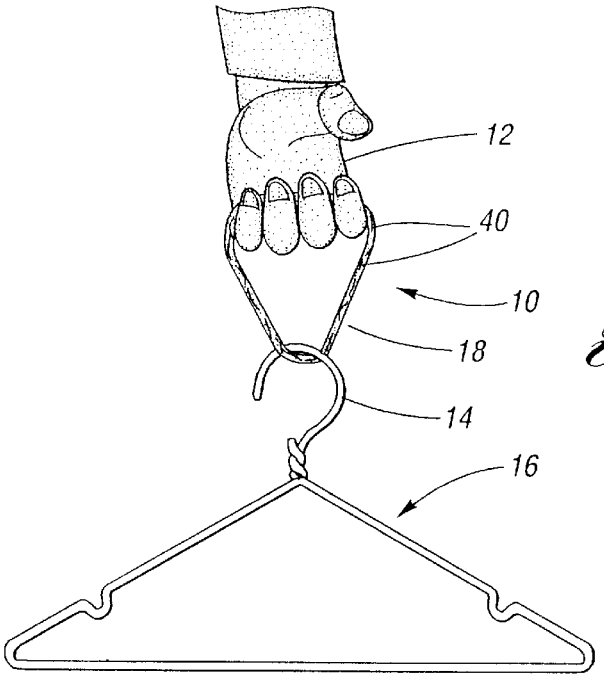
FIG. 1 is a perspective view of the clothes hanger carrier according to the present invention, shown in a first mode of operation.
Figure 2:
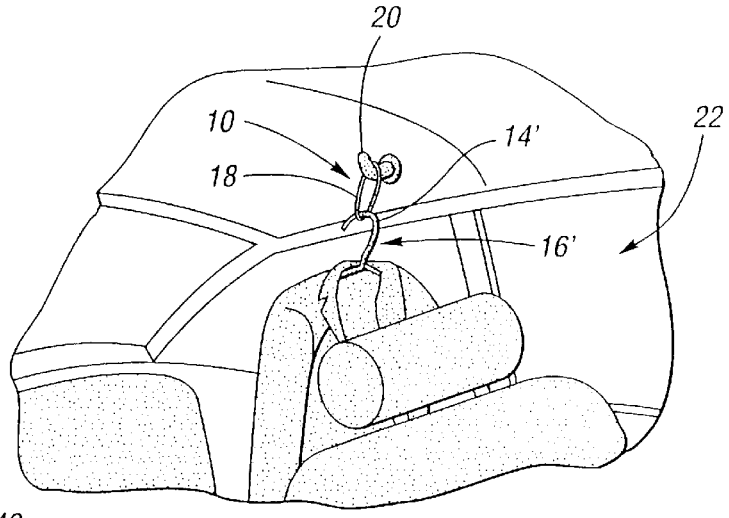
FIG. 2 is a perspective view of the clothes hanger carrier according to the present invention, shown in a second mode of operation.

Referring now to the Drawing at FIGS. 1 and 2, the flexible clothes hanger carrier 10 according to the present invention is depicted in two different modes of operation. At FIG. 1 a first mode of operation of the flexible clothes carrier 10 is shown, wherein someone is grasping in his of her hand 12 the flexible clothes hanger carrier and the hook portion 14 of a clothes hanger 16 is hooked onto the flexible loop 18 that constitutes the flexible clothes hanger carrier. At FIG. 2 a second mode of operation of the flexible clothes carrier 10 is shown, wherein the loop 18 of the flexible clothes hanger carrier 10 is hooked onto a vehicular hook member 20 of a motor vehicle passenger compartment 22, wherein the hook portion 14' of at least one clothes hanger 16' is hooked onto the loop.

Figure 4:
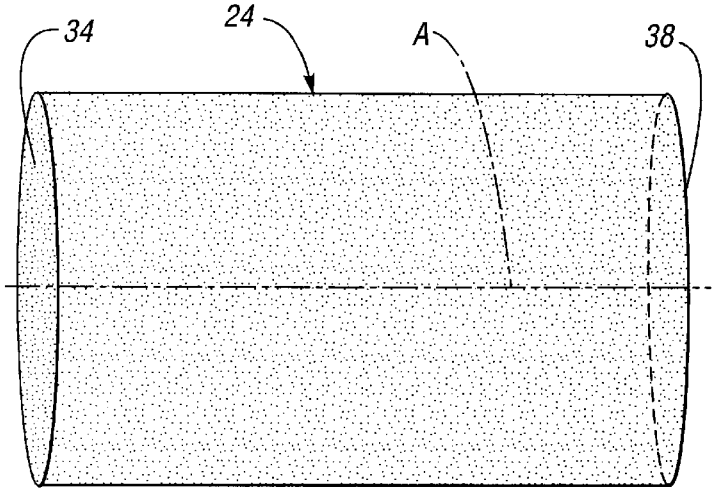
FIG. 4 is a top plan view of the flaccidly flexible tube formed from the plastic bag of FIG. 3.
Figure 5:
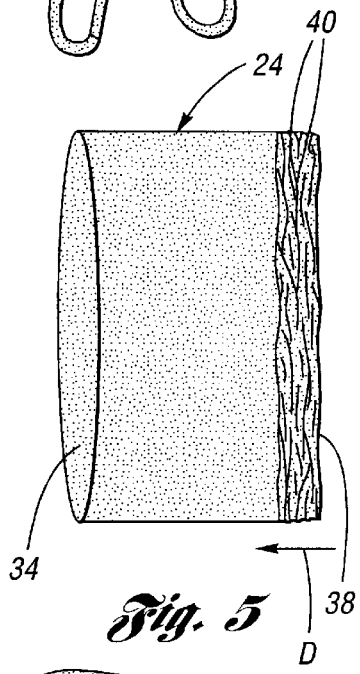
FIG. 5 is a top plan view of the flaccidly flexible tube being kneadingly crumpled into a flexible loop according to the present invention.
Figure 6:
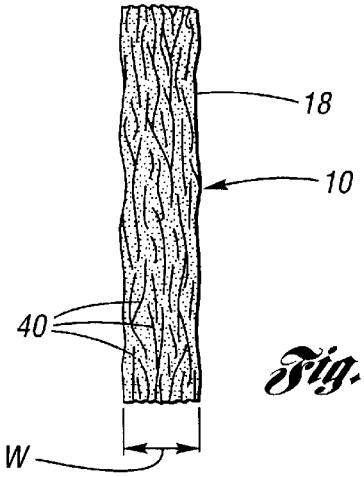
FIG. 6 is a top plan view of the flexible loop formed from transversely cutting and kneadingly crumpling the plastic bag of FIG. 3.
Figure 7:
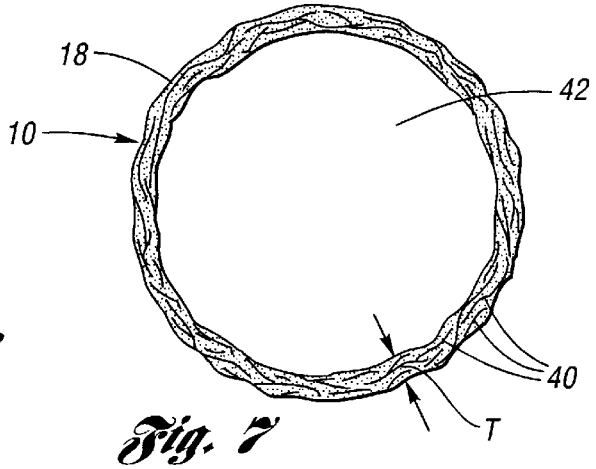
FIG. 7 is an end view of the flexible loop of FIG. 6.

The clothes carrier hanger 10 is formed of the aforementioned loop 18. The loop 18 (shown at FIGS. 6 and 7) is formed from a flaccidly flexible plastic tube 24 (shown at FIG. 4) which has been axially crumpled (shown at FIG. 5). In the preferred method of making the flexible loop 18, the flaccidly flexible tube 24 is formed from a plastic bag 26 (shown at FIG. 3), wherein the closed end 28 thereof is cut off.

Figure 3:
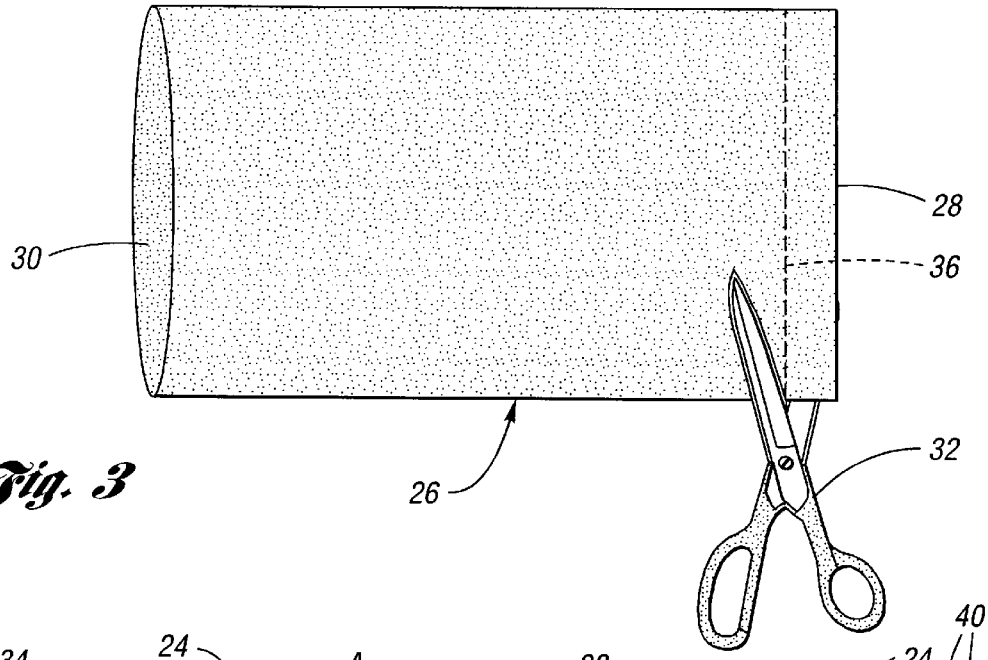
FIG. 3 is a top plan view of a plastic bag being cut transversely to thereby provide a flaccidly flexible tube therefrom.

With reference to FIGS. 3 though 7, the preferred method of making the loop 18 of the flexible clothes hanger carrier 10 will now be detailed.

A plastic bag 26 is selected composed of a flaccidly flexible plastic, preferably having a thickness of less than 1 mil. The bag 26 has an open mouth end 30 and an opposite closed end 28. The bag 26 is cut transversely, such as by scissors 32 or a knife, so that the closed end 28 is cut off. Now, the bag 26 has been transformed into a flaccidly flexible tube 24, wherein the open mouth 30 forms a first open end 34 and the cut 36 provides an opposite second open end 38.

Now, the flexible loop 18 is formed from the flaccidly flexible tube 24 by axial crumpling. The crumpling process is preferred to begin as a plurality of crumples 40 formed at one of the first and second ends 34, 38 and proceeding to the other of the first and second ends. The flexible loop 18 thereby formed has a central opening 42. The crumpling process is preferred to be performed in two steps.

The first crumpling step provides axial crumpling parallel to the axis A of the flaccidly flexible tube 24, thereby bringing the first and second ends 34, 38 together. This process may be conveniently provided by the flaccidly flexible tube 24 being grasped at one end, for example the second end 38, and the thumb and fingers of two hands kneading the flaccidly flexible tube in the direction D toward the other (first) end. The first crumpling step provides a flexible loop 18 which is unlikely to be compact.

The second crumpling step is performed after the first crumpling step, and provides a compact flexible loop 18 having minimized axial width W and minimized thickness T. This process may be conveniently provided by grasping the flexible loop 18 so that the opposed index finger and thumb of each hand knead the flexible loop in a compressible manner as the flexible loop is rotated through the hands. The flexible loop 18, depending upon the hand kneading, results in the flexible loop acquiring an axial width W on the order for example of about one inch and a thickness T on the order for example of about one-half inch.

Upon completion of the first and second crumpling steps, the flexible loop 18 should have assumed a crudely annular (toroidal) shape. While the flexible loop 18 is very flexible and very compressible, it very strongly resists outward radial stretching when opposing circumferentially opposite locations of the flexible loop are mutually pulled apart. In response to such an opposed radially outward force, the flexible loop 18 responsively assumes an elongated shape, as shown in FIGS. 1 and 2.

Alternatively, either or both of the first and second crumpling steps may be performed by an automated machine operation.

The circumference of the flexible loop 18 is basically defined by the selection of the circumference of the bag 26. By way of example only, the first and second ends may be ten inches apart, and the circumference of the bag may be fourteen inches.

Figure 8:
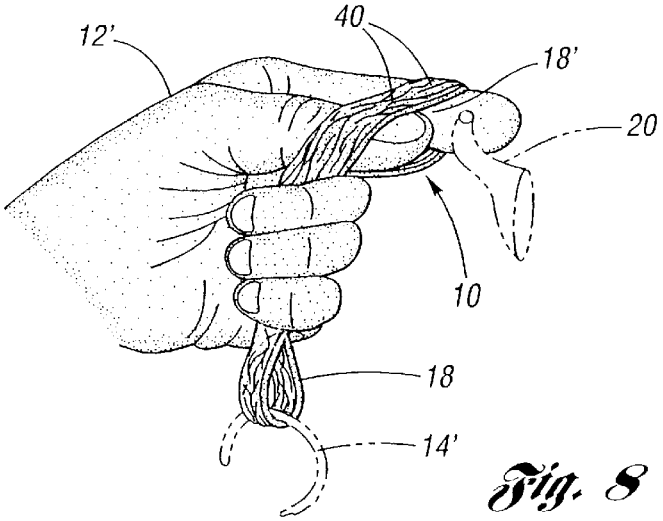
FIG. 8 is a perspective view of the flexible loop of FIG. 6 being placed onto a vehicular hook member of a motor vehicle according to the second mode of operation of the flexible clothes hanger carrier.

Operation will now be detailed with reference in particular to FIGS. 1, 2 and 8.

In the first mode of operation shown at FIG. 1, the hook portion 14 of a clothes hanger 16 is interfaced with the clothes hanger carrier 10 by hooking onto the flexible loop 18. Now the flexible loop provides a comfortably resilient handhold allowing any number of clothes weighted clothes hangers to be holdably held in the hand for long durations.

In the second mode of operation, the flexible loop 18 is easily placed upon a vehicular hook member 20 of an automobile passenger compartment 22 by someone grasping the flexible loop 18 in his of her hand 12' such that the flexible loop is conformed to include an upper loop portion 18' for being holdably placed onto the vehicular hook member. One or more clothes hangers 16' are hooked, via the hook portion 14' thereof, onto the flexible loop 18 so that any number of clothes hangers may be simultaneously held thereby.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A method for supporting clothes hangers with respect to an article comprising the steps of:

axially crumpling a flaccidly flexible tube of plastic sheeting generally everywhere between open ends thereof to thereby provide a large plurality of crumples in the sheeting which bring the first and second open ends toward each other and thereby results in a flexible plastic loop of the plastic sheeting;

placing the loop holdably onto an article; and hooking a hook portion of at least one clothes hanger onto the loop.

2. A method for providing a flexible clothes hanger carrier comprising:

providing a flaccidly flexible tube of plastic sheeting having first and second open ends; and axially crumpling the tube generally everywhere between the first and second open ends to thereby provide the tube with a large plurality of crumples that bring the first end toward the second end and thereby form a flexible loop of the plastic sheeting.

3. The method of claim 2, wherein said step of providing provides the tube with a first open end and an opposite second open end; and wherein said step of axially crumpling comprises crumpling said tube from one of said first and second ends to the other of said first and second ends.

4. The method of claim 3, further comprising the step of compressing the loop to thereby minimize width and thickness dimensions thereof.

5. The method of claim 2, wherein said step of providing comprises transversely cutting a plastic bag to thereby cut off a closed end thereof.

6. A flexible clothes hanger carrier product made according to the method of claim 2.

* * * * *